United States Patent [19]

Murano

[11] 4,100,764

[45] Jul. 18, 1978

[54] AIR-CONDITIONING APPARATUS

[75] Inventor: Mitsuo Murano, Fujinomiya, Japan

[73] Assignee: Tokyo Shibaura Electric Co., Ltd., Japan

[21] Appl. No.: 792,343

[22] Filed: Apr. 29, 1977

[30] Foreign Application Priority Data

Apr. 30, 1976 [JP] Japan ..... 51-49700
Jun. 29, 1976 [JP] Japan ..... 51-76940

[51] Int. Cl.[2] ..... F25D 21/14; F25D 23/12; F25D 19/00

[52] U.S. Cl. ..... 62/289; 62/262; 62/298

[58] Field of Search ..... 62/289, 298, 262

[56] References Cited

U.S. PATENT DOCUMENTS

| | | | |
|---|---|---|---|
| 2,751,760 | 6/1956 | Williams, Jr. | 62/289 |
| 2,939,297 | 6/1960 | Karger et al. | 62/298 |
| 3,174,301 | 3/1965 | Thornton et al. | 62/291 |
| 3,635,046 | 1/1972 | Sato et al. | 62/173 |
| 3,703,087 | 11/1972 | MacLeod | 62/262 |
| 3,766,749 | 10/1973 | Livesay | 62/298 |

*Primary Examiner*—Lloyd L. King
*Attorney, Agent, or Firm*—Oblon, Fisher, Spivak, McClelland & Maier

[57] ABSTRACT

An air-conditioning apparatus, of the room air-conditioning type which can be easily installed at any desired location in a room, as in a window therein, comprising a cabinet structure, a cabinet insulation structure and a partition board dividing the interior of the cabinet into an interior compartment and an exterior compartment. The insulation structure consists of right side, left side, top and bottom insulation boards. The insulation structure and the partition board are all made of plastic insulation material, such as polystyrene resin foam. Each insulation board has a plurality of projections and grooves corresponding with each other and with portions of the refrigeration components, such as the condenser and the evaporator, so that these components are fixedly interposed therebetween, when assembled.

16 Claims, 9 Drawing Figures

AIR-CONDITIONING APPARATUS

BACKGROUND OF THE INVENTION

1. Field of the Invention

This invention relates generally to an air-conditioning apparatus, but is more particularly concerned with an insulating structure made of foamed plastic insulation material, such as foamed polystyrene resin, furnished inside the cabinet structure of an easily installed air-conditioner of the type usually installed in a window of a room to be cooled.

2. Description of the Prior Art

Heretofore, many types and forms of insulating structures have been provided for air-conditioners. For the purpose of insulating previous air-conditioners, pliable insulation materials, such as polyethyrene sheets, were pasted upon the cabinet walls. In all of these prior devices, however, the refrigeration components were mounted on some form of metallic supporting members, which need a large number of screws and bolts for their joints. Furthermore, not only the screw-driving operation, but also the sticking of flexible insulation materials, makes a unit unnecessarily heavy, awkward, and difficult to handle during fabrication and maintenance operations.

With respect to these shortcomings, U.S. Pat. No. 2,751,760, by J. Williams et al., discloses a window type air-conditioner with a wall member that is integrally formed with the cabinet. The wall member and the cabinet however, undoubtedly need insulating with a kind of insulation material which used to be applied in the prior art. U.S. Pat. No. 3,174,301, by C. Thornton et al., also discloses a window type air-conditioner whose heat exchangers are fixedly held and so insulated, but the cabinet and the barrier wall are yet to be insulated so that they are apparently provided with insulation material which has been presented in the U.S. Pat. No. 3,635,046 by Sato et al. that was proposed in advance of this application in an attempt to provide a compact, easily-installed high workability air-conditioning apparatus.

SUMMARY OF THE INVENTION

It is therefore a primary object of the present invention to provide an improved, compact, inexpensive and light weight air-conditioning apparatus which can be moved to any desired location in a room to be cooled and can be installed with great facility.

Another object of the present invention is to provide an air-conditioning apparatus whose cabinet structure is thermally insulated by four plastic insulation boards, held in close contact for complete insulation.

Another important object of the invention is to provide an air-conditioning apparatus with a partition board made of foamed polystyrene resin separating one compartment from the other.

Another object is to provide an air-conditioning apparatus with an interior fan case integrally formed at the foot of a partition board for the purpose of decreasing the number of components of which the unit is consisted for an easy assemblage.

A further object is to provide an air-conditioning apparatus with four plastic insulating boards closely connecting together to strengthen the cabinet structure and to allow each cabinet wall to be of decreased thickness.

Still another object is to provide an air-conditioner with a functional and compact cabinet wall which can be fashioned in the unit with increased workability.

A further object of the invention is to provide an air-conditioning apparatus which can be assembled with as little labor as possible and which does not require as many screw-driving operations as former such air conditioning apparatus.

Another object of the invention is to provide an air-conditioning apparatus with an improved heat exchanger supporting means.

Another object is to provide an air-conditioning apparatus with an improved housing for the electric elements thereof.

Another object is to provide an air-conditioner with an improved hand hold to permit easy carrying and installation thereof.

Another object of this invention is to thermally insulate the rear wall with a part of the fan case.

The foregoing and other objects are achieved according to the present invention by the provision of a room type air-conditioner having a cabinet structure, a cabinet insulation structure and a partition board dividing the interior of the cabinet into an interior compartment and an exterior compartment. The insulation structure consists of a right side, left side, top and bottom insulation boards. The insulation structure and the partition board are all made of plastic insulation material, such as polystyrene resin foam. Each insulation board has a plurality of projections and grooves corresponding with each other and with portions of the refrigeration components, such as the condenser and the evaporator, so that these components are fixedly interposed therebetween, when assembled.

BRIEF DESCRIPTION OF THE DRAWINGS

Other objects and many of the attendant advantages of this invention will be readily appreciated by reference to the following detailed description when considered in connection with the accompanying drawings in which.

DETAILED DESCRIPTION OF A PREFERRED EMBODIMENT

In the particular embodiment of the present invention depicted in the accompanying drawings, it will be noted that a room-type air-conditioning apparatus has been selected to illustrate a preferred application of the invention.

Figure 1:
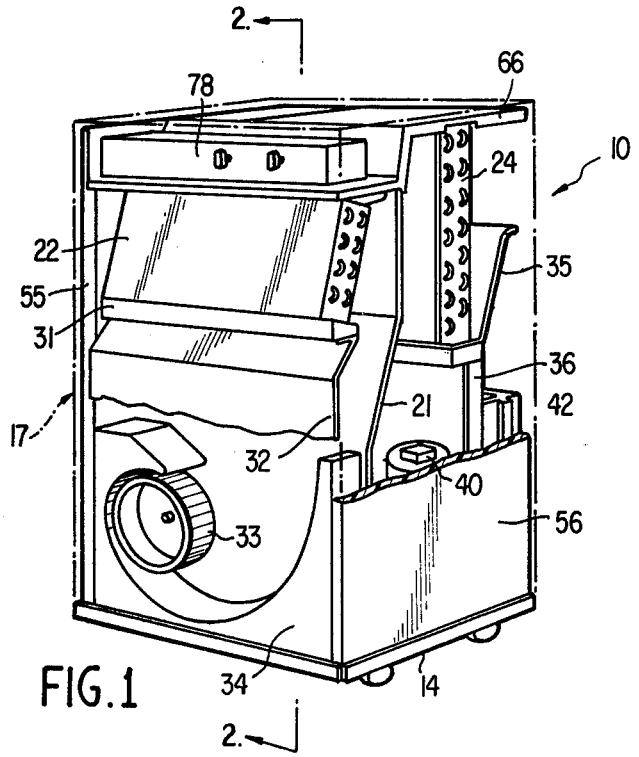
FIG. 1 is a perspective view of an air-conditioning unit according to the present invention.
Figure 2:
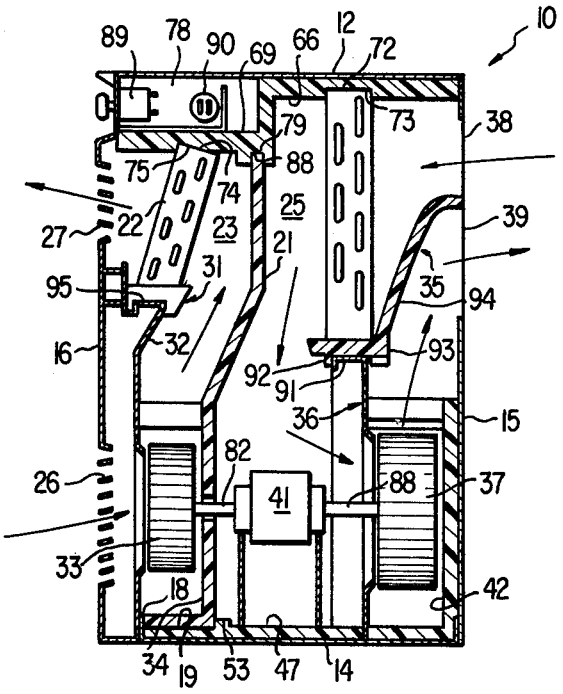
FIG. 2 is a longitudinal sectional view of FIG. 1 taken along the line 2—2.
Figure 3A:
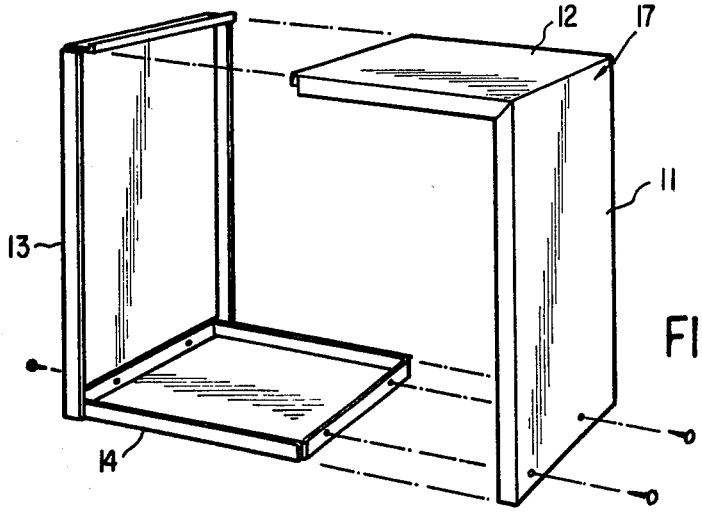
FIGS. 3(*a*) and 3(*b*) are perspective views of the cabinet structure encircling the air-conditioning unit of FIGS. 1 and 2.
Figure 3B:
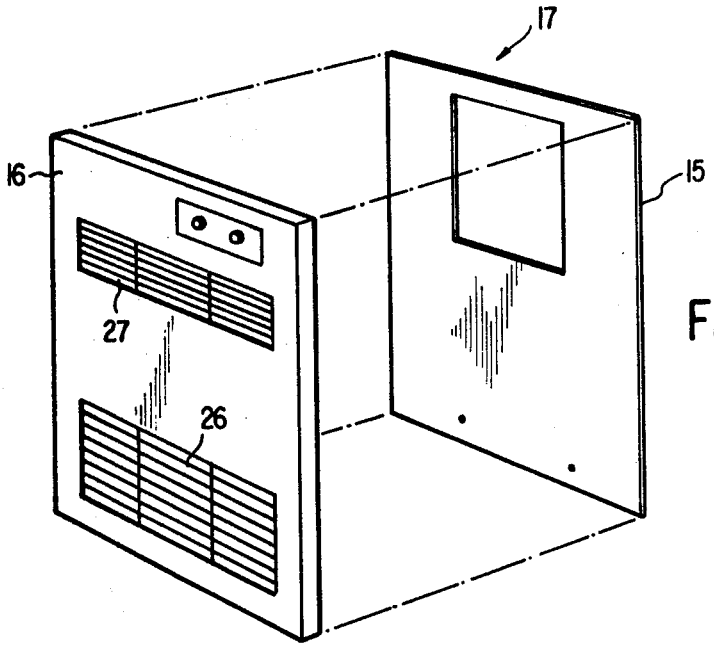

The air-conditioner unit of the present invention is indicated generally by the reference character 10 in FIGS. 1 and 2, and is covered externally by a cabinet structure 17, shown in FIGS. 3(*a*) and 3(*b*). The cabinet structure 17 comprises a right side wall 11, which is integrally fashioned with an upper wall 12, a left side wall 13, which is opposite the right side wall 11, a bottom wall 14, a rear wall 15 and a front wall 16. All of these walls are made of thin metal plate, except the front wall 16, which is formed of plastic material.

The air-conditioning unit 10 is divided at large by a partition board 21 into two conventional compartments, namely the interior compartment 23, in which the interior heat exchanger 22 and the like are disposed, and the exterior compartment 25, in which the exterior heat exchanger 24 and the like are disposed.

With reference to the air flow through the interior compartment 23, the front wall 16 has an intake 26, through which circulated air from the space being cooled may be directed into the compartment 23 for a thermal exchange and forced out through an outlet 27 formed in the upper section. For drawing simplification purposes, no refrigerant carrying conduits have been shown as joining the compressor, condenser, evaporator and components together, but it will be understood that such conduits are provided and that the refrigeration system is charged with suitable refrigerant and operated in a well-known conventional manner.

On the other hand, air from the outside of the room is taken into the exterior compartment 25 through the air inlet 38 and driven out from the outlet 39 in the same manner described above, the air inlet 38 and the outlet 39 being connected to the duct members, not shown, which are normally mounted in the corner of a window. These preferably are made of two flexible pipes, arranged coaxially, one within the other, or being spirally wound. Inside the interior compartment 23 are contained, besides the interior heat exchanger 22, a drainage pan 31, which stores produced drain, a guide plate 32, an interior fan 33 and an interior fan case 34 housing the interior fan. In the exterior compartment 25 are mounted the exterior heat exchanger 24, an exterior drainage pan 35 for created drain, a vertically extending guide plate 36 on which the drainage pan 35 is disposed, an exterior fan 37, an exterior fan case 42, a fan motor 41 for driving the fans 33 and 37 and a compressor 40.

Figure 4:
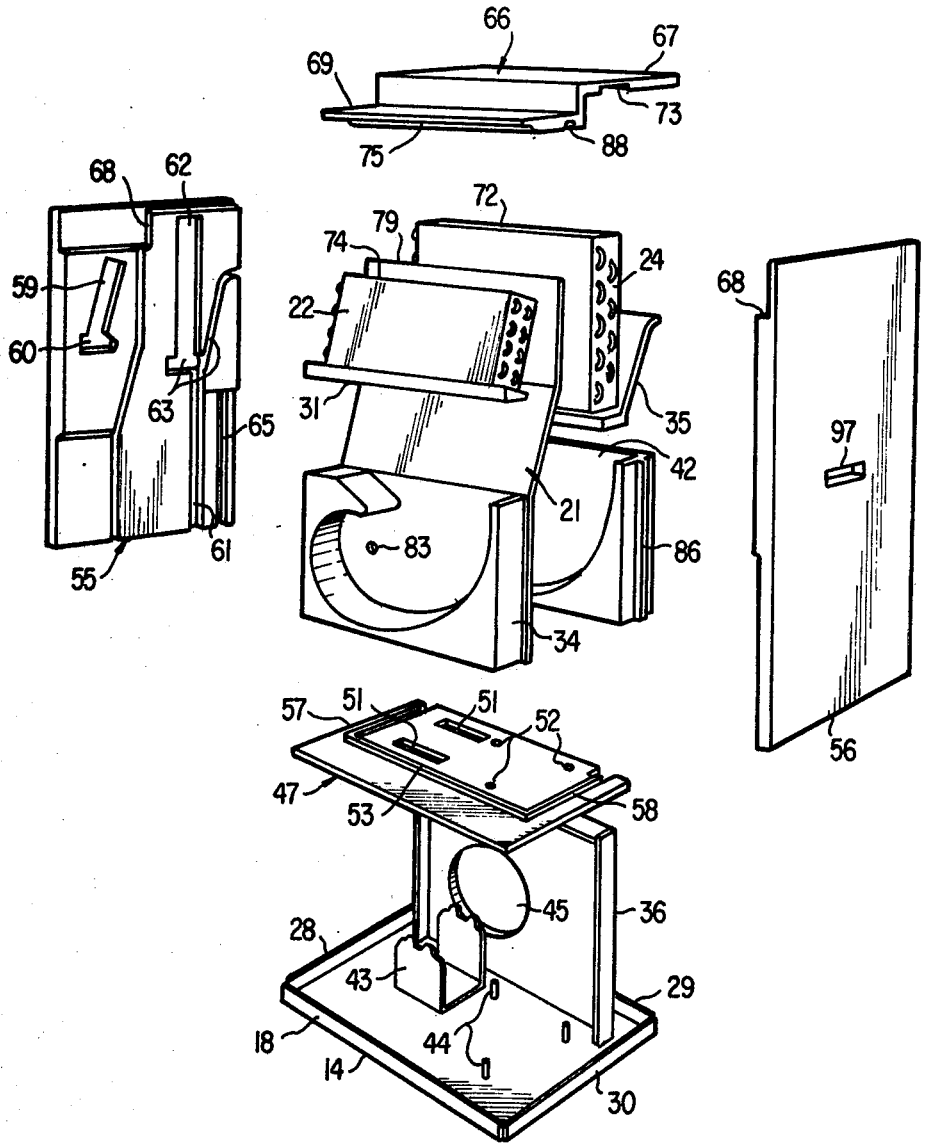
FIG. 4 is an exploded perspective view of the unit illustrated in FIG. 1.

As shown in FIG. 4, the bottom wall 14 is placed at the foot of all the components, whereby it is essential that the bottom wall 14 be as strong as is necessary to suspend the whole weight of the unit. Accordingly, the bottom wall 14 is made of 1 mm-thick steel plate. On the four ends of the bottom wall are integrally formed vertically standing banks 18, 28, 29 and 30, to provide more strength for the wall. On the surface, a motor base 43, with two uprightly stretching and oppositely disposed posts, for supporting the fan motor 41, is welded, along with three leg members 44 for supporting the compressor 40, and also welded thereto is the guide plate 36, which has approximately at its center an induction hole 45, being arranged in the exterior compartment part 25 of the bottom wall 14. The periphery of the induction hole 45 projects toward the fan motor 41, forming a guide passage for air to reduce the noise generated and to reinforce the guide plate 36.

As is further shown in FIG. 4, a bottom insulating board 47 covers the bottom wall 14. It is preferred that the bottom insulating board 47 be molded from a suitable thermal insulation plastic foam resin, such as polystyrene foam. In preparation for setting the motor base 43 and the leg members 44, a pair of apertures 51 and three holes 52 are dug in the corresponding positions of the bottom insulating board 47.

To assist in the fabrication of the device, the interior surface of the bottom insulating board 47 is embossed or grooved, such as shown in FIG. 4. This embossed carving consists of a front portion 53, a left side portion 57 and a right side portion 58. The front portion 53, when placed on the bottom wall 14, together with the front bank 18, forms a subsiding channel 19 to couple the bottom part of the interior fan case 34, as best seen in FIG. 2. In the same manner, the left side portion 57 and the right side portion 58, along with the left side bank 28 and the right side bank 30, respectively form channels to hold a left side insulating board 55 and a right side insulating board 56.

The left side insulating board 55, shown in FIG. 4, is actually made of injected polystyrene foam. It stands vertically along and closely contacting the inside surface of the left side wall 13. A plurality of grooves is formed on the inside of this left side insulating board 55, including a groove 59 which shelters the end side of the interior heat exchanger 22, groove 60 which shelters the end side of the drainage pan 31, a vertically extending groove 61 which shelters the end side of the guide plate 36, a groove 62 which fixedly holds the end side of the exterior heat exchanger 24, groove 63 which holds the end side of the drainage pan 35, groove 64 which fixedly supports the end side of the partition wall 21 and groove 65 which shelters a side projection 86 of the exterior fan case 42. In the same manner, a plurality of grooves, in a symmetrical arrangement to that of the left side insulating board 55, are carved on the inside of the right side insulating board 56 which is oppositely disposed, cooperating with the left one to hold fixedly between them those refrigeration elements, such as the heat exchangers and the drainage pans and so forth. Therefore, the components interposed by both of the boards are thermally isolated from the outside and completely prevented from heat exchanging, consequently increasing the thermal efficiency of the whole unit.

Moreover, it is widely known that the insulating material, such as polystyrene foam, performs as a buffer and it generally absorbs any shocks and vibrations given unexpectedly to the unit which might otherwise cause damage and bring about undesirable influences on the components.

The top insulating board 66 is placed astraddle the top surfaces of the side insulating boards 55 and 56. As shown in FIG. 4, this board consists of an upper board portion 67 provided with a channel-like groove 73, dug on its interior side to shelter the top end 72 of the exterior heat exchanger 24, and a lower board portion 69, having two grooves 75 and 88, the groove 75 obliquely sheltering the top end 74 of the interior heat exchanger 22 and the groove 88 fixedly holding the top edge 79 of the partition board 21, to guarantee that no airflow shall take place from one compartment to the other.

Also, as shown in FIG. 2, a room 78, situated in the upper front portion of the unit, is obtained when the unit is assembled. The electric elements such as a thermal switch 89 and an electric condenser 90, are collectively gathered together in this room for easy operation and maintenance, not only for users, but also for service electricians.

Figure 5:
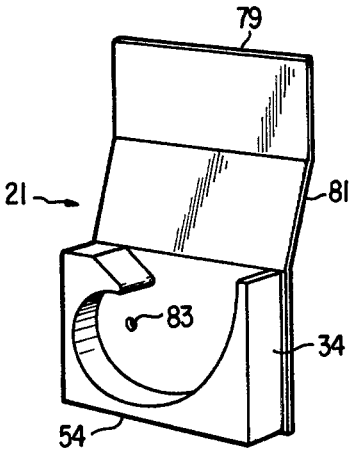
FIG. 5 is a perspective view of a partition board, with an interior fan case integrally formed therein, taken from the apparatus illustrated in FIG. 4.

The partition board 21, shown in FIG. 5, is also preferably made of a plastic thermal insulation board, such as polystyrene foam. A vertical portion 79 of the partition board is continuously followed by an oblique portion 81 forming an escape from the fan motor 41 and the compressor 40, as shown in FIG. 2, and ensuring smooth airflow. At the foot of the oblique portion 81 is integrally formed the interior fan case 34, with a hole 83 in an approximate center for the motor shaft 82. This partition wall 21 is fixedly positioned, its left end by the left insulating board 55, its right end by the right insulating board 56, its top end by the top insulating board 66, and its bottom end by the bottom insulating board 47, when fashioned.

As shown in FIG. 2, the exterior fan case 42 is placed at the rear of the guide plate 36 and houses the exterior fan 37. This case 42 is made of the same material as that of the interior fan case 34, as well, and thermally insulates the rest of the bottom wall 14 with its bottom and the rear wall 15 with its back, simultaneously.

Figure 6:
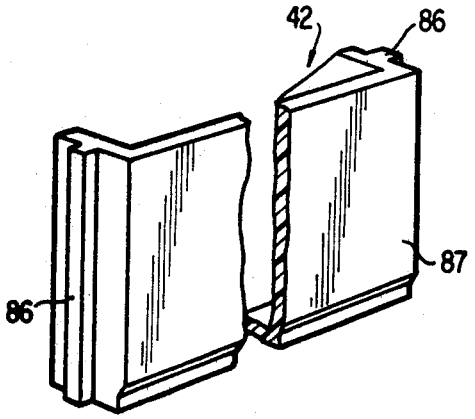
FIG. 6 is a partially cutaway perspective view of the exterior fan case, taken from the apparatus shown in FIG. 4.

At both sides of the fan case 42, as shown in FIG. 6, are integrally formed ridges 86 for coupling with the grooves 61 of the side insulating boards 55 and 56. The backboard 87 of this case so tightly touches the rear wall 15, when positioned that it is not necessary to paste any flexible insulation material on the rear wall, such as polyethylene sheets and the like, and the workability of assembling this air-conditioning unit can be exceedingly improved.

As shown in FIG. 2, at the bottom of the drainage pan 35 there is formed a horizontal ridge 92 extending from one side to the other. This ridge plays a large part in firmly connecting the drainage pan 35 to the top portion 91 of the guide plate 36. The drainage pan 35, according to the invention, comprises a water pan 93 storing produced drainage and the arched wall 94 stretching therefrom to gather splashed drainage and to partition the air inlet from the air outlet. With regard to the weight needed to shape the partitioning means, the arched wall 94 weighs less than those previous ones which used to be made of metals.

The exterior heat exchanger 24 sits on drainage pan 35 while its top end 72 fixedly connects to the groove 73 of the top insulating board 66 herein described. Furthermore, the combination of the guide plate 36, the drainage pan 35, the exterior heat exchanger 24 and the top insulating board 66 is coupled to both the left side insulating board 55 and the right side insulating board 56 with the grooves 61, 62, 63, and 68, as shown in FIG. 4.

Figure 7:
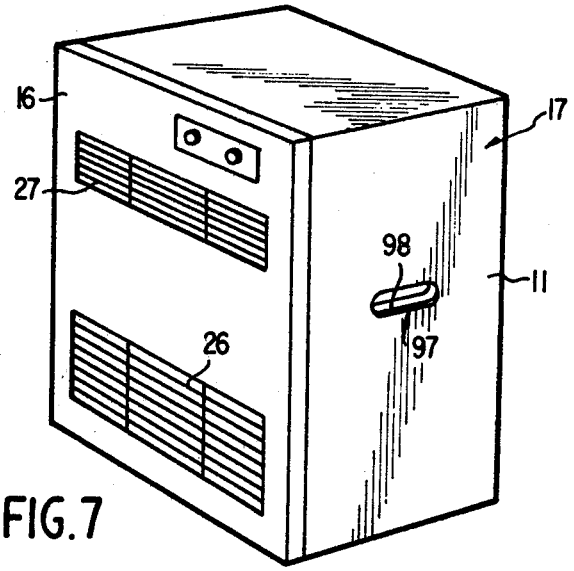
FIG. 7 is an external perspective view of the air-conditioning unit according to the present invention.
Figure 8:
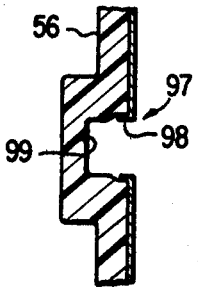
FIG. 8 is a longitudinal sectional view of a hand hold, shown in FIG. 7.

According to the structure of the present invention for fixing the heat exchanger, no screws are involved, and in addition the produced drainage is ensured in the drainage pan 35, such that it is extremely convenient to overhaul, inspect, assemble and maintain general air conditioning units. In front of the interior fan 33 is placed an indoor guide plate 32, shown in FIGS. 1 and 2. On a top plane 95 formed therewith is laid the drainage pan 31, on which is placed the interior heat exchanger 22, in the same manner as the exterior heat exchanger 24 and its drainage pan 35. This top end of this heat exchanger 22 is also fixed to the groove 75 of the top insulation board 66. Both sides of the interior heat exchanger 22 and the interior drainage pan 31 are sheltered in the grooves 59 and 60 of the side insulation boards 55 and 56. As shown in FIG. 7, each side wall 11 and 13 of the unit has a hand hold 97 that is provided with an opening 98. The opening 98, in FIG. 8, is surrounded with a recess 99 of the side insulation board to prevent air flow from one side to the other and for receiving a man's hands to firmly hold the air conditioning unit.

Obviously many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air conditioning apparatus comprising:

a cabinet structure consisting of bottom, right side, left side, top, front and rear walls;

a refrigeration system arranged in said cabinet structure;

an insulation structure made of foamed plastic insulating material consisting of bottom, right side, left side and top insulation boards for thermally insulating said cabinet structure, each of which is in a closely mating relationship with said corresponding wall and each having catch means therewith for interconnecting adjoining insulation boards together and for fixedly disposing therebetween components of said refrigeration system, when assembled; and a partition member made of the same material as that of said insulating structure, with its bottom, right, left and top sides firmly and fixedly positioned by said catch means of said insulating structure for dividing the cabinet interior into an interior compartment, including an interior fan case housing an interior fan, and an exterior compartment, including an exterior fan case housing an exterior fan.

2. An apparatus as set forth in claim 1, in which said interior fan case is provided with an interior guide plate having therewith an induction hole for introducing air to the interior fan, while said exterior fan case is also provided with an exterior guide plate having therewith an induction hole for introducing air to the exterior fan.

3. An apparatus as set forth in claim 2, in which said interior fan case is made of foamed plastic insulation material.

4. An apparatus as set forth in claim 2, in which said exterior fan case is made of foamed plastic insulation material.

5. An apparatus as set forth in claim 2, in which both said interior and exterior fan cases are made of foamed plastic insulation material.

6. An apparatus as set forth in claim 1, in which said partition member is formed integrally with said interior fan case.

7. An apparatus as set forth in claim 2, in which said foamed plastic insulation material is of polystyrene foam.

8. An apparatus as set forth in claim 2, in which on said exterior guide plate is placed an exterior drainage pan, storing produced drainage, and an exterior heat exchanger of said refrigeration system has its bottom end placed on said exterior drainage pan and its top end fixedly positioned by said catch means of said top insulation board.

9. An apparatus as set forth in claim 2, in which on said exterior guide plate is placed an exterior drainage pan, storing produced drainage, and an exterior heat exchanger of said refrigeration system has its bottom end placed on said exterior drainage pan, its top end fixedly positioned by said catch means of said top insulation board, and its right side and left side ends together, with those of said drainage pan and said guide plate, firmly sheltered in said catch means of said right side and left side insulation boards.

10. An apparatus as set forth in claim 2, in which said bottom insulation board is provided with a plurality of slit-like apertures for accepting therein a fan motor base and a plurality of round apertures for accepting therein legs for a compressor of said refrigeration system.

11. An apparatus as set forth in claim 2, in which said bottom insulation board is provided with a plurality of slit-like apertures for accepting therein a fan motor base, a couple of round apertures for accepting therein legs for a compressor of said refrigeration system, and embossed carving therewith to accommodate the bottom parts of said side insulating boards and said interior fan case.

12. An apparatus as set forth in claim 8, in which said exterior drainage pan consists of a storing pan for storing produced drainage and an arched wall provided therewith helping partition inflow air from outflow air in said exterior compartment.

13. An apparatus as set forth in claim 4, in which said exterior fan case includes a rear plate in a closely mating relationship with said rear wall of said cabinet structure to provide insulation.

14. An apparatus as set forth in claim 1, in which said right side and left side insulation boards are provided with a plurality of catch means therewith for disposing therebetween interior and exterior heat exchangers, interior and exterior drainage pans, interior and exterior fan cases and interior and exterior guide plates.

15. An apparatus as set forth in claim 1, further comprising a room for disposing electric elements spaced by said top wall cooperating with said cabinet structure.

16. An apparatus as set forth in claim 1, further comprising hand-holds formed by an aperture defined by said side wall whose periphery has a flanged portion therewith and a recess presented at a corresponding position to said aperture of said side insulation board.

* * * * *